US008540085B2

(12) United States Patent
Klump et al.

(10) Patent No.: US 8,540,085 B2
(45) Date of Patent: Sep. 24, 2013

(54) DISHWASHER RACK ASSEMBLY WITH ADJUSTABLE TINES

(75) Inventors: James Murray Klump, Crestwood, KY (US); Rebecca Lynne Hannon, South Lyon, MI (US)

(73) Assignee: General Electric Company, Schenectady, NY (US)

( * ) Notice: Subject to any disclaimer, the term of this patent is extended or adjusted under 35 U.S.C. 154(b) by 103 days.

(21) Appl. No.: 13/112,124

(22) Filed: May 20, 2011

(65) Prior Publication Data

US 2012/0292269 A1 Nov. 22, 2012

(51) Int. Cl.
*A47B 81/04* (2006.01)

(52) U.S. Cl.
USPC ..... 211/41.9; 134/135

(58) Field of Classification Search
USPC ..... 211/12, 41.1, 41.2, 41.3, 41.4, 41.5, 211/41.6, 41.8, 41.9, 85.15, 171, 175; 134/56 D, 57 D, 58 D, 135, 177; 220/487, 488, 572; 312/228, 228.1
See application file for complete search history.

(56) References Cited

U.S. PATENT DOCUMENTS

| | | | | |
|---|---|---|---|---|
| 3,126,098 | A | 3/1964 | Geiger et al. | |
| 3,269,548 | A | 8/1966 | Geiger et al. | |
| 3,402,975 | A | 9/1968 | Smith | |
| 3,433,363 | A * | 3/1969 | Clearman et al. | 211/41.8 |
| 3,451,556 | A | 6/1969 | Macoicz | |
| 3,752,322 | A | 8/1973 | Fiocca et al. | |
| 4,046,261 | A | 9/1977 | Yake | |
| 4,606,464 | A | 8/1986 | Jordan et al. | |
| 5,158,185 | A * | 10/1992 | Michael et al. | 211/41.8 |
| 5,249,590 | A * | 10/1993 | Jacobus et al. | 134/135 |
| 5,351,837 | A | 10/1994 | Smith | |
| 6,571,965 | B1 * | 6/2003 | Beck et al. | 211/41.8 |
| 6,827,225 | B2 * | 12/2004 | Miilu et al. | 211/41.9 |
| 6,848,585 | B2 | 2/2005 | VanLandingham | |
| 7,267,131 | B2 * | 9/2007 | Woo | 134/135 |
| 7,682,465 | B2 | 3/2010 | Anderson et al. | |
| 7,793,790 | B2 * | 9/2010 | Lee | 211/41.9 |
| 8,104,628 | B2 * | 1/2012 | Kim | 211/41.8 |
| 2003/0089672 | A1 * | 5/2003 | VanLandingham | 211/41.8 |
| 2006/0108298 | A1 * | 5/2006 | Kim | 211/41.8 |
| 2006/0157430 | A1 * | 7/2006 | Disch et al. | 211/41.3 |
| 2006/0254992 | A1 * | 11/2006 | Lim | 211/41.9 |
| 2006/0254993 | A1 * | 11/2006 | Lee | 211/41.9 |
| 2006/0254994 | A1 * | 11/2006 | Lim | 211/41.9 |
| 2007/0247039 | A1 * | 10/2007 | Anderson et al. | 312/228.1 |
| 2009/0090681 | A1 * | 4/2009 | Graute | 211/41.9 |

FOREIGN PATENT DOCUMENTS

| | | |
|---|---|---|
| KR | 20080012597 | 2/2008 |

* cited by examiner

*Primary Examiner* — Joshua Rodden
(74) *Attorney, Agent, or Firm* — Dority & Manning, P.A.

(57) ABSTRACT

A dishwasher rack assembly includes a bottom wall formed of spaced apart lateral rods crossed by spaced apart longitudinal rods to define an open lattice structure. A plurality of fixed vertical tines extend upward from the bottom wall and are arranged in pairs along the longitudinal or lateral rods of the bottom wall with a defined space between adjacent pairs of the fixed vertical tines. A frame structure is provided with a shape and size so as to slide along the bottom wall between the pairs of fixed vertical tines. A plurality of vertical tines extend upward from the frame structure and are arranged in pairs along the frame structure. A securement mechanism is configured between the frame structure and the bottom wall to accommodate relative movement and anchoring between the frame structure and the bottom wall for variable positioning of the frame structure tines relative to the pairs of fixed vertical tines.

20 Claims, 8 Drawing Sheets

FIG. —1—

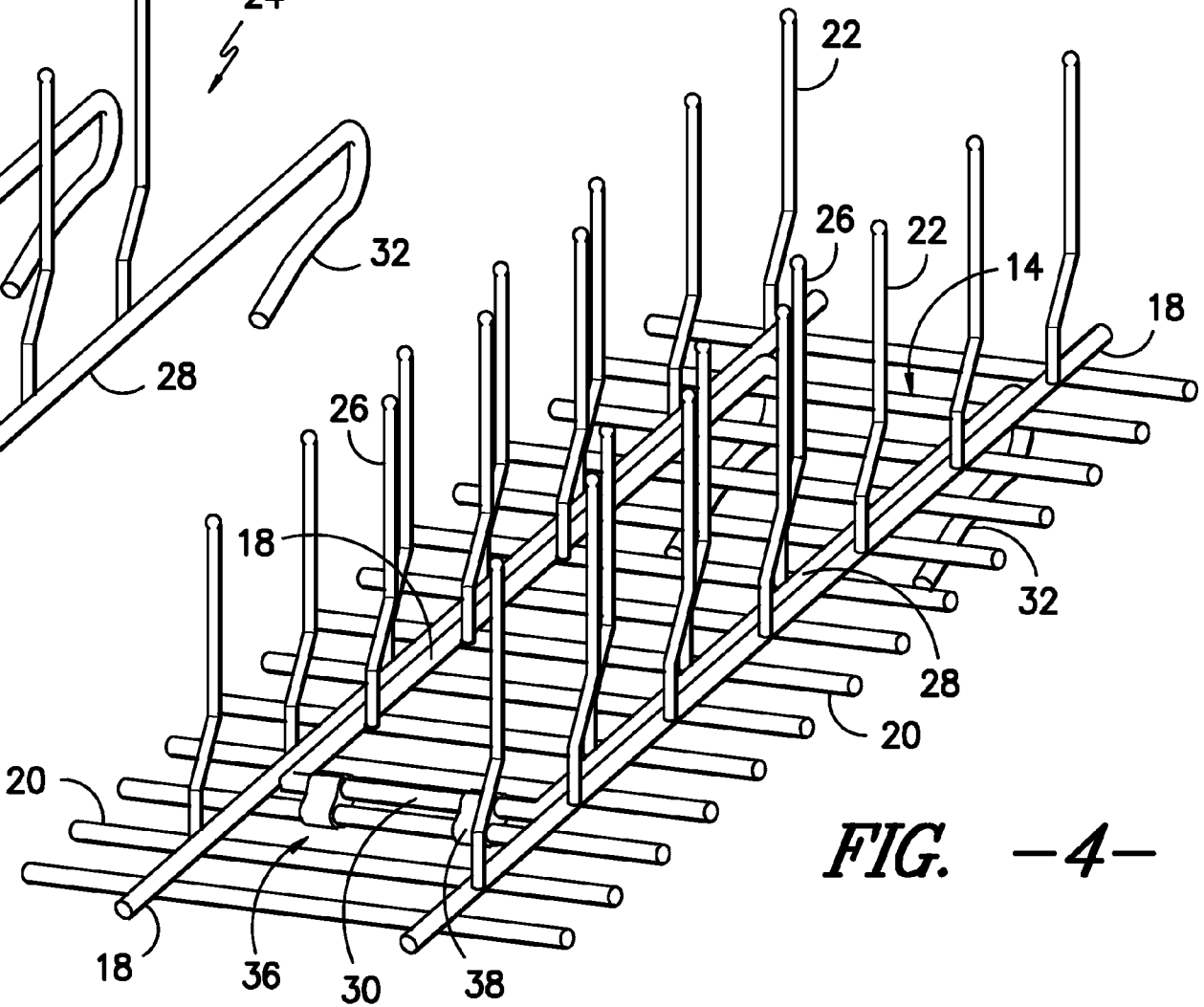
FIG. —4—
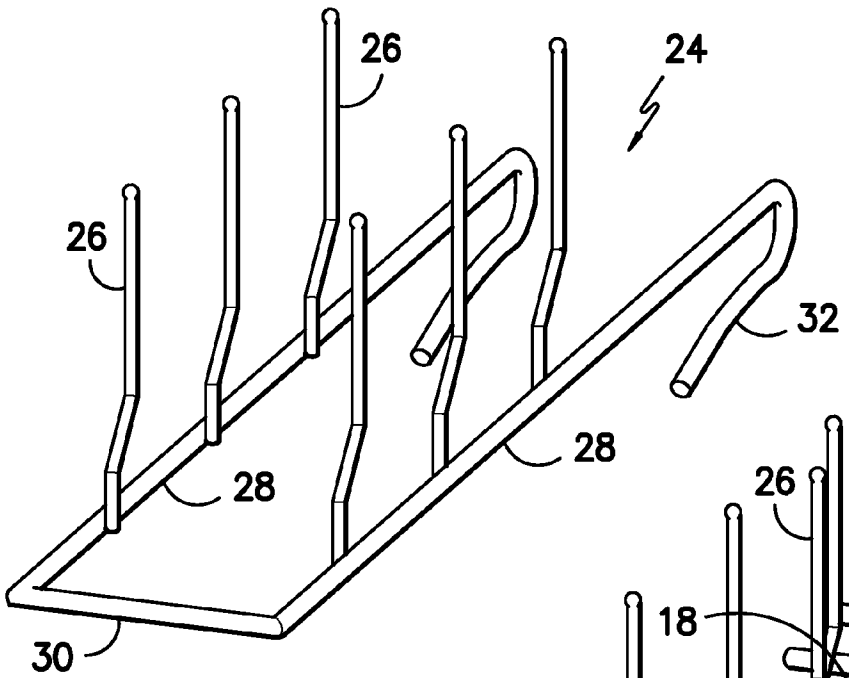
FIG. —3—

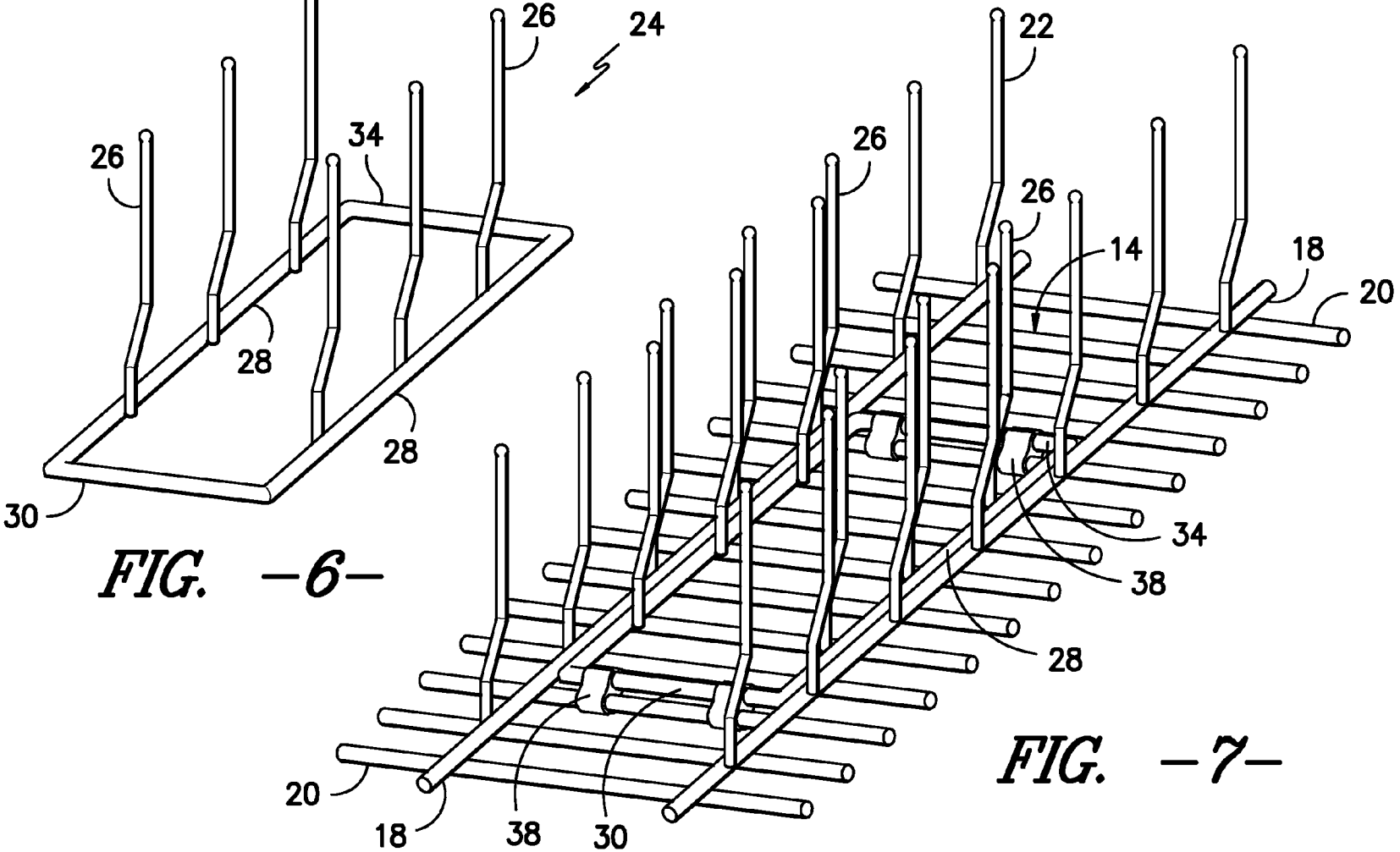
FIG. —7—
FIG. —6—

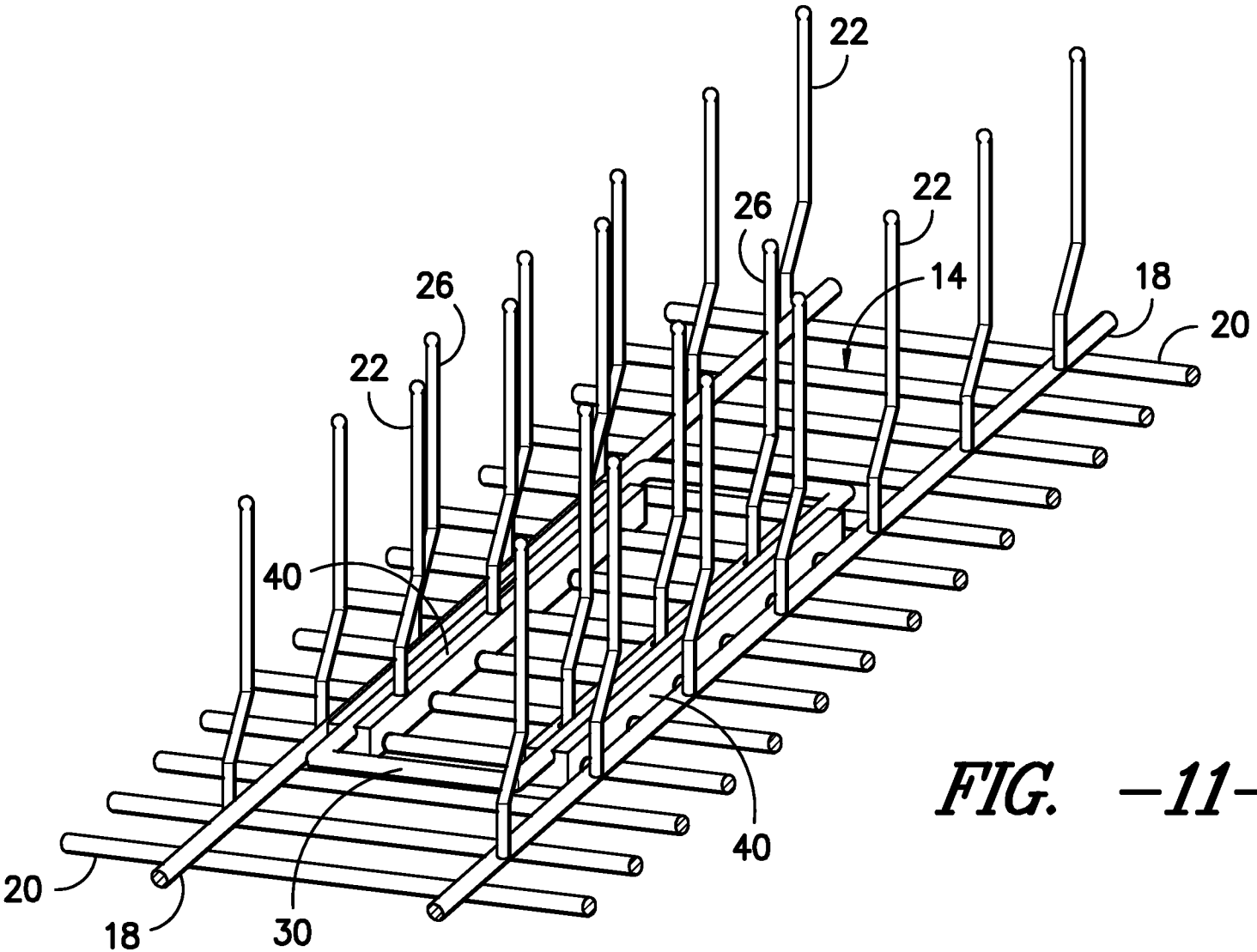
FIG. —11—

DISHWASHER RACK ASSEMBLY WITH ADJUSTABLE TINES

FIELD OF THE INVENTION

The present invention relates generally to rack assemblies for use in domestic dishwashers, and more particularly to a rack assembly with adjustable tines.

BACKGROUND OF THE INVENTION

Conventional dishwashers normally include two racks configured to support items to be washed, such as dishes, glasses, bowls, cooking utensils, and the like. Typically, an upper rack is disposed close to the top of the washing chamber and is used to hold glasses, cups, bowls, and other relatively smaller items. The lower rack is positioned near the bottom of the chamber at a considerable distance below the upper rack to provide vertical clearance for larger items, such as dishes and platters, to be placed on edge, and to hold preparation bowls and pots in an up-side-down orientation. Each rack normally is supplied with an array of spaced apart, generally vertical tines or fingers that support and separate the individual items. The optimum spacing between adjacent tines for supporting thin items like dishes is much less than for supporting thick items like mixing bowls and pans. Thus any fixed array of tines is less than optimum for all possible combinations of items to be washed.

There have been numerous suggestions for arrangements to provide adjustable tines in a rack assembly for user flexibility. Reference is made, for example, to U.S. Pat. Nos. 3,126,098; 3,269,548;3,402,975; 3,752,322; 4,046,261; 4,606,464; and 5,351,837.

The industry is continuously seeking improvements in rack assemblies that provide consumers with ease of adjustment of tines. The present invention relates to such improvements.

BRIEF DESCRIPTION OF THE INVENTION

Aspects and advantages of the invention will be set forth in part in the following description, or may be obvious from the description, or may be learned through practice of the invention.

In accordance with aspects of the invention, a dishwasher rack assembly is provided having a bottom wall formed of spaced apart lateral rods crossed by spaced apart longitudinal rods to define an open lattice structure. A plurality of fixed vertical tines extend upwardly from the bottom wall and may be attached to the lateral rods, the longitudinal rods, or the juncture of the lateral and longitudinal rods. The fixed vertical tines are arranged in pairs along the longitudinal or lateral aspect of the bottom wall with a defined space between adjacent pairs of the fixed vertical tines. A frame structure is provided with a shape and size so as to slide along the bottom wall between the pairs of fixed vertical tines. A plurality of vertical tines extend upwardly from this frame structure and are arranged in pairs along the frame structure. A securement mechanism is configured between the frame structure and the bottom wall and serves to anchor and yet accommodate relative movement between the frame structure and the bottom wall for variable positioning of the frame structure tines relative to the pairs of fixed vertical tines.

In a particular embodiment, the frame structure is a rectangular member with longitudinal legs. The frame structure tines may be disposed along the longitudinal legs with a spacing that corresponds to the spacing between the pairs of fixed vertical tines on the bottom wall. The rectangular member may be variously configured. For example, in one embodiment, the member may have a width such that the longitudinal legs lie directly adjacent to the pairs of fixed vertical tines. In another embodiment, the longitudinal legs may be laterally spaced from the fixed vertical tines.

In one exemplary embodiment, the frame structure is adjustable between a first position wherein the frame structure tines are spaced mid-way between the pairs of fixed vertical tines and a second position wherein the frame structure tines are aligned (e.g. doubled-up) with the fixed vertical tines. In this embodiment, the frame structure may include a first end leg that connects to a first lateral rod of the bottom wall in the first position and to a second adjacent lateral rod in the second position of the frame structure.

The securement mechanism may be, for example, any manner of suitable clip or clips that attach the first end leg to the rods. In still a further embodiment, the frame structure may include hooks at ends of the longitudinal legs opposite from the first end leg, with the hooks having a length and shape so as to extend around and under the rods of the bottom wall in the various adjusted positions of the frame structure. In still further embodiments, the frame structure may include a second end leg opposite from the first end leg, with the second end leg also connectable to first and second rods of the bottom wall in the first and second adjusted positions of the frame structure.

Another unique embodiment includes a rectangular frame structure member having longitudinal legs, with the frame structure tines spaced apart along the longitudinal legs with a spacing that corresponds to the spacing between the pairs of fixed vertical tines on the bottom wall. The securement mechanism in this embodiment may include channel members that attach to the bottom wall between the fixed vertical tines, with longitudinal legs of the frame structure slidable within the channel members. The frame structure may be variably positionable at any position along the channel members. In another embodiment, the channel members include discrete position locations spaced along the length thereof for receipt of the frame structure tines. The channel members may attach to the lateral rods of the bottom wall between adjacent longitudinal rods.

The various dishwasher rack assembly embodiments are not limited to any particular use or location within the dishwasher, and may be used as lower racks or upper racks. The rack assembly may be particularly useful as an upper rack wherein the fixed vertical tines define a center bowl region of the upper rack. In this embodiment, the fixed vertical tines may be attached to every-other one of the lateral rods along the center bowl region, wherein in a first position of the frame structure, the frame structure tines are aligned with the fixed vertical tines, and in a second position of the frame structure, the frame structure tines are aligned with the lateral rods that are without fixed vertical tines.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 is a perspective view of an embodiment of an adjustable frame structure;

FIG. 4 is a perspective view of the frame structure of FIG. 3 at a first position along the bottom wall of the rack assembly;

FIG. 6 is a perspective view of another embodiment of an adjustable frame structure;

FIG. 7 is a perspective view of the frame structure of FIG. 6 at a first position along the bottom wall of the rack assembly;

FIG. 11 is a perspective side of the embodiment of FIG. 10 with the frame structure at a second position along the bottom wall of the rack assembly.

DETAILED DESCRIPTION OF THE INVENTION

Figure 1:
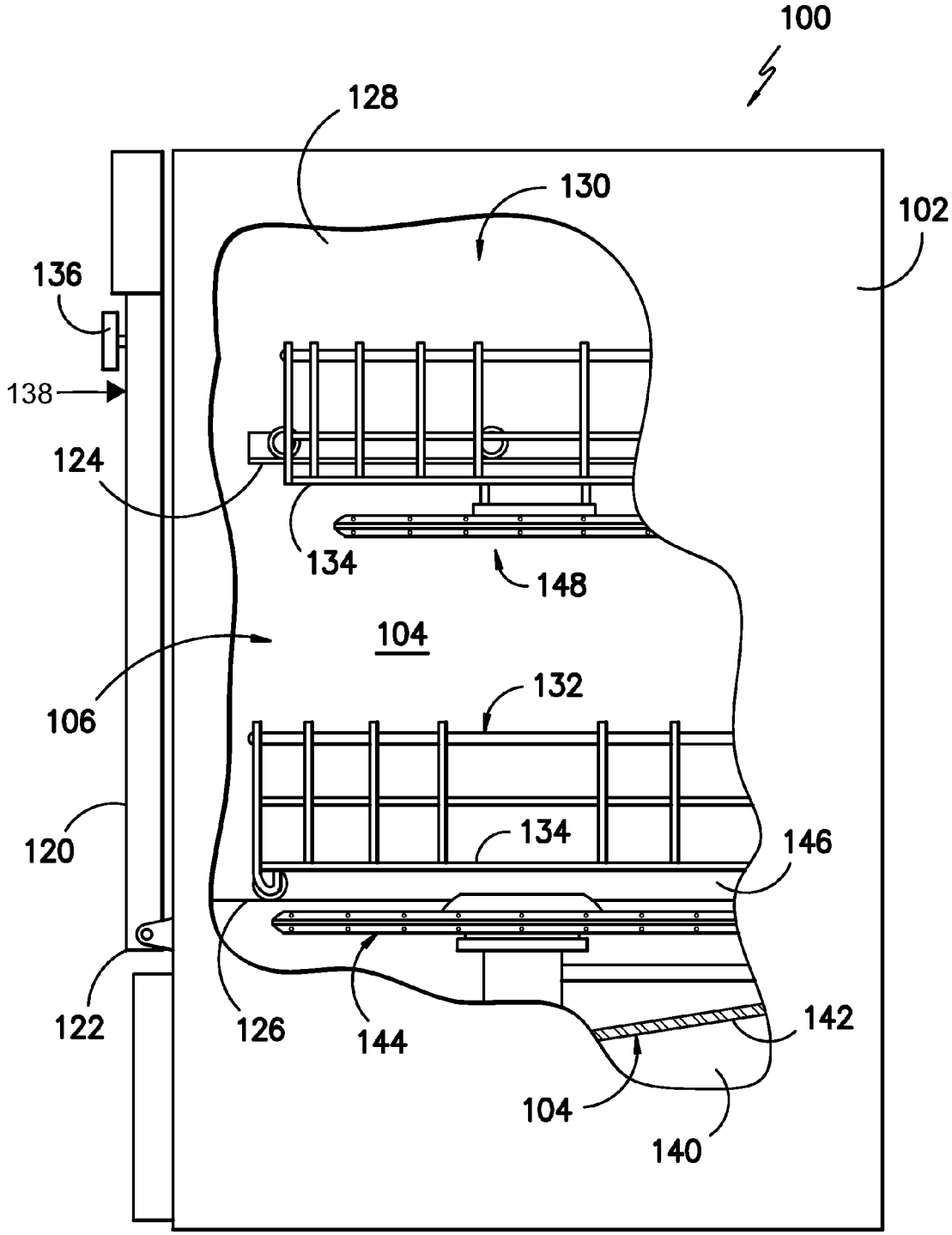
FIG. 1 is a side, partially broken-way view of an exemplary dishwasher.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a view of an exemplary domestic dishwasher 100 shown in partial cut-away and is representative of a type of a dishwasher that may incorporate a rack assembly in accordance with aspects of the invention. It should be appreciated, however, that the present rack assemblies are not limited to use in any particular type of dishwasher, and that the dishwasher 100 in FIG. 1 is presented for illustrative purposes only.

Briefly, the dishwasher 100 includes a cabinet 102 having a tub 104 therein that defines a wash chamber 106. The tub 104 includes a front opening (not shown in FIG. 1) and a door 120 hinged at its bottom 122 for movement between a normally closed vertical position wherein the wash chamber 106 is sealed shut for washing operation, and a horizontal open position for loading and unloading of dishwasher contents. Upper and lower guide rails 124, 126 are mounted on tub side walls 128 and accommodate upper and lower roller-equipped rack assemblies 130, 132, respectively. Each of upper and lower racks 130, 132 is fabricated from known materials into lattice structures that include longitudinal rods 134 and crossing lateral rods (not visible in FIG. 1). Each rack assembly 130, 132 is adapted for movement between an extended loading position in which the rack is substantially positioned outside the wash chamber 106, and a retracted position (shown in FIG. 1) in which the rack is located inside wash chamber 106. Typically, a silverware basket (not shown) is removably attached to the lower rack 132 for placement of silverware, utensils, and the like that are too small to be accommodated by upper and lower racks 130, 132.

A control input selector 136 is mounted at a convenient location on an outer face 138 of the door 120 and is coupled to control circuitry and control mechanisms for operating a fluid circulation assembly to circulate water and dishwasher fluid in the dishwasher tub 104. The fluid circulation assembly is located in a machinery compartment 140 located below a bottom sump portion 142 of the tub 104.

A lower spray-arm-assembly 144 is rotatably mounted within a lower region 146 of the wash chamber 106 and above tub sump portion 142 so as to rotate in relatively close proximity to the lower rack assembly 132. A mid-level spray-arm assembly 148 is located in an upper region of the wash chamber 106 and is located in close proximity to the upper rack 130 and at a sufficient height above lower rack 132 to accommodate larger items, such as a dish or platter. In a further embodiment, an upper spray assembly may be located above the upper rack assembly 130 at a sufficient height to accommodate taller items in the upper rack assembly 130.

Figure 2:
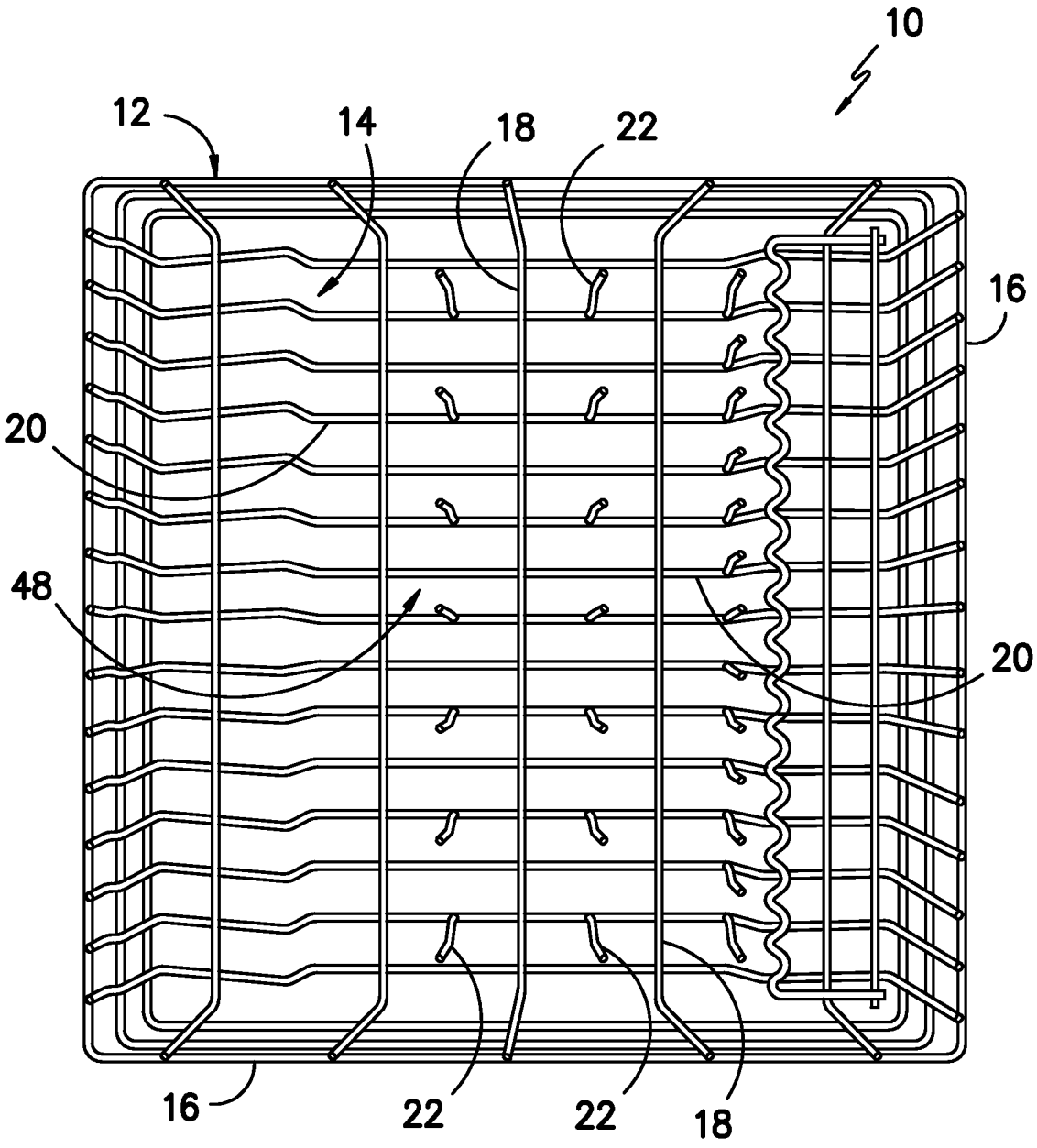
FIG. 2 is a top view of a component of a rack assembly.

FIG. 2 is a perspective view of a rack assembly 10 in accordance with aspects of the invention. Although depicted as a top rack assembly particularly suited for cups, bowls, and other relatively smaller items, it should be appreciated that a rack assembly 10 in accordance with the invention may also be configured as a lower rack particularly suited for dishes, plates, and other relatively larger items. The rack assembly 10 is not limited by its use or location within the a dishwasher. The rack assembly 10 is generally configured as a basket-like structure 12 having a bottom wall 14 and surrounding sidewalls 16. The bottom wall 14 and sidewalls 16 may be formed with wire or rod members into an open lattice structure. For example, the bottom wall 14 may be defined by a plurality of longitudinal rods 18 that are crossed with a plurality of lateral rods 20, as generally known in the art. The rods 18, 20 may be connected together by any suitable means, including welding, epoxy, clips, and so forth. A plurality of fixed tines 22 project vertically upward from the bottom wall 14 from any combination of the rods 18, 20. The fixed tines 22 are arranged in pairs along the longitudinal aspect of the bottom wall 14 with a defined space of "pitch" between adjacent pairs of the tines 22.

Referring to FIGS. 3 and 4, an embodiment of a frame structure 24 is illustrated as having a shape and a size so as to slide along the bottom wall 14 of the rack assembly 10 (FIG. 2) in the longitudinal direction between the pairs of fixed vertical tines 22. A plurality of vertically oriented tines 26 are arranged on the frame structure 24 in pairs along the longitudinal legs 28 of the frame structure 24. A securement mechanism is configured between the frame structure 24 and the bottom wall 14. This securement mechanism accommodates relative movement of the frame structure 24 along the bottom walls 14 for variable positioning of the frame structure 24 relative to the pairs of fixed vertical tines 22. In this way, the tines 26 configured on the frame structure 24 can be varied relative to the fixed tines 22. The securement mechanism also anchors the frame structure 24 relative to the bottom wall 14.

In the embodiment depicted in FIGS. 3 and 4, the frame structure 24 is a generally rectangular member having longitudinal legs 28 and at least one first end leg 30. As mentioned above, the tines 26 are spaced along the longitudinal legs 28 with a spacing between adjacent pairs of the tines 26 that corresponds essentially to the spacing between the fixed pairs of tines 22 (FIG. 4). In this embodiment, the rectangular frame structure 24 has a width such that the longitudinal legs 28 lie essentially directly adjacent to the pairs of fixed tines 22, as depicted in FIG. 4. For example, the legs 28 of the frame structure 24 may slide generally adjacent to the longitudinal rods 18 of the bottom wall 14.

FIG. 4 depicts a first position of the frame structure 24 wherein the tines 26 are positioned mid-way between adjacent pairs of the fixed tines 22 on the bottom wall 14. This position thus provides a significantly greater number of tines in the same space, with a decreased spacing or pitch between the tines. This configuration may be desired for relatively small, flat articles, such as saucers, small dishes, and the like.

Figure 5:
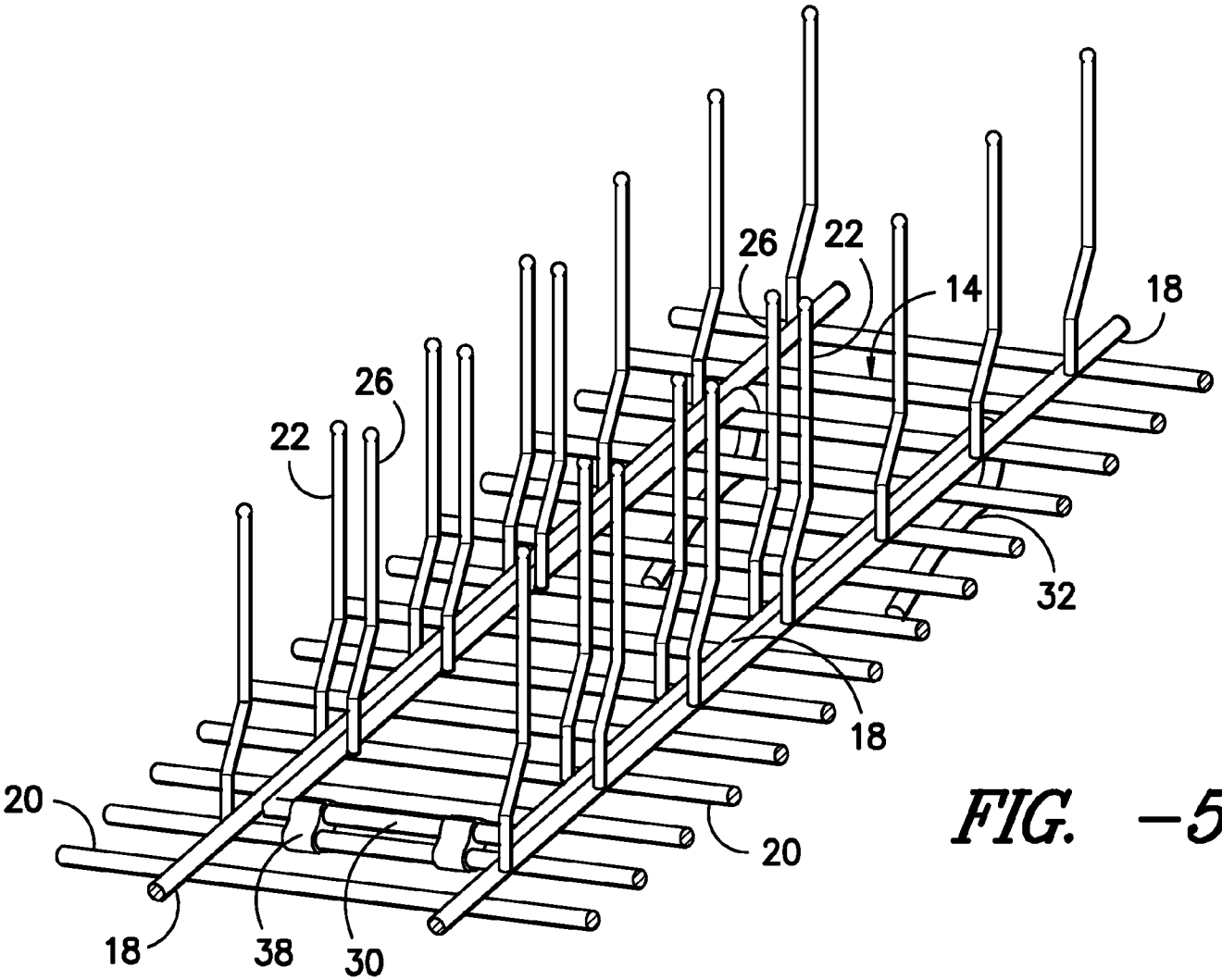
FIG. 5 is a perspective side of the embodiment of FIG. 4 with the frame structure at a second position along the bottom wall of the rack assembly.

The frame structure 24 is movable to a second position depicted in FIG. 5 wherein the tines 26 on the frame structure 24 are essentially aligned with the fixed vertical tines 22. Thus, in this position, the tines 26, 22 are essentially doubled-up and the tines 26 do not interfere with relatively larger articles that would be supported between the fixed tines 22.

Referring still to FIGS. 4 and 5, the first end leg 30 of the frame structure 24 may removably connect to respective different ones of the lateral rods 20 in the first and second positions of the frame structure 24 by any suitable securing mechanism, such as the clips 38 depicted in FIGS. 4 and 5. To reposition the frame structure, a consumer need only to unclip the clips 38 from the first lateral rods 20 and move the clip and frame structure 24 to another desired lateral rod 20 to change the pitch between the fixed tines 22 and the tines 26 on the frame structure 24, as depicted in FIGS. 4 and 5.

FIGS. 3 through 5 depict an embodiment of the frame structure wherein the opposite ends of the longitudinal legs 28 include hooks 32 configured thereon. The hooks 32 have a length and a shape so as to extend around and under the lateral rods 20 in the various adjusted positions of the frame structure 24, as depicted in FIGS. 4 and 5. This particular embodiment may be desired in that it is not necessary to manipulate clips on both ends of the frame structure 24.

Figure 8:
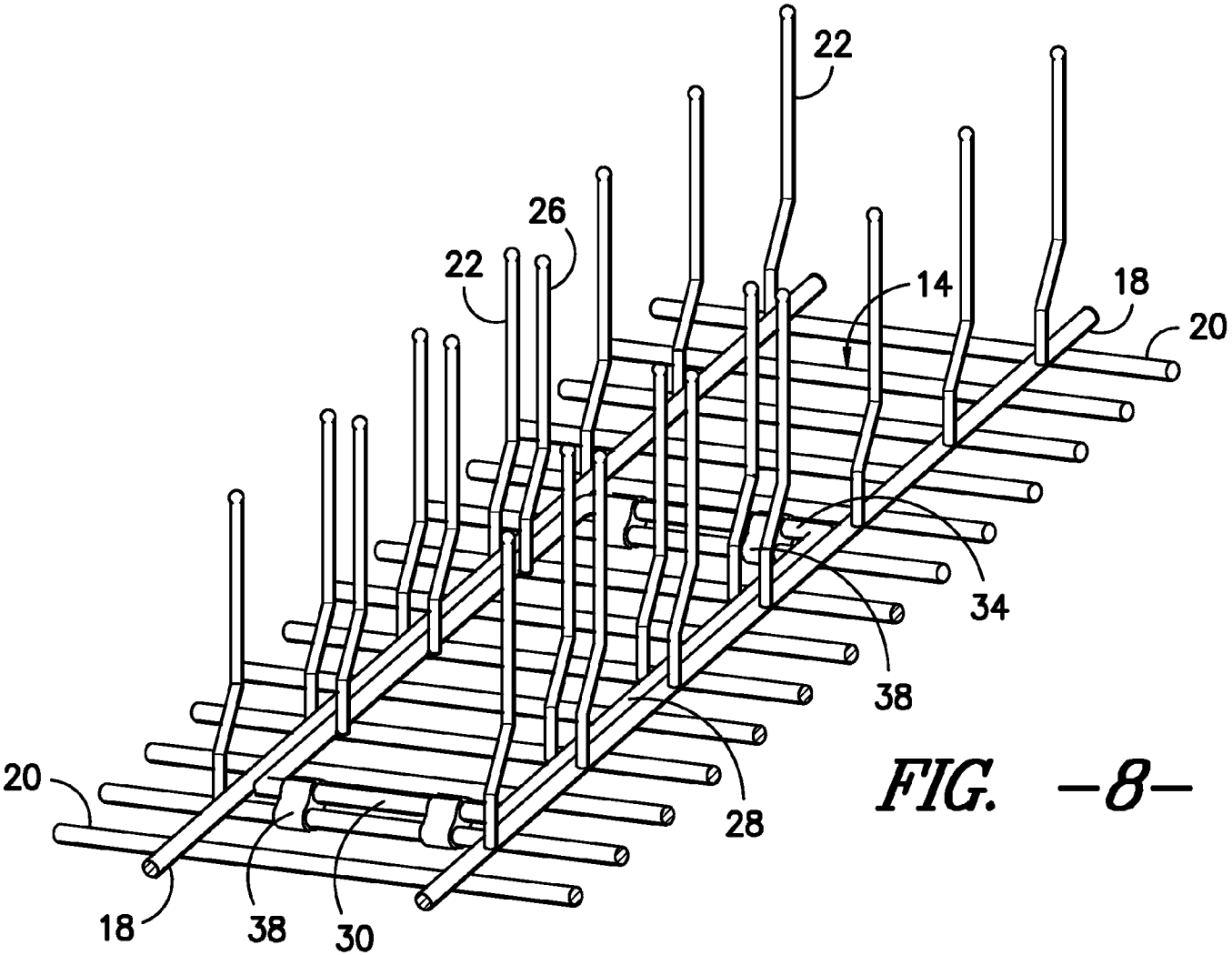
FIG. 8 is a perspective side of the embodiment of FIG. 7 with the frame structure at a second position along the bottom wall of the rack assembly.

Referring to FIGS. 6 and 7, an alternate embodiment of the frame structure 24 is depicted wherein the structure includes a second end leg 34 opposite the first end leg 30 such that the frame structure 24 defines a closed rectangular structure with the tines 26 configured on the longitudinal legs 28. Referring to FIG. 7, clips 38 may be used to secure the second end leg 34 to different ones of the lateral rods 20 in the various adjusted positions of the frame structure 24 depicted in FIGS. 7 and 8. In the position of FIG. 7, the tines 26 on the frame structure 24 are positioned mid-way between the fixed tines 22 and the clip 38 as the first end 30 and second end 34 of the frame structure are attached to respective lateral rods 20. In the adjusted position of the frame structure 24 in FIG. 8, the tines 26 are aligned with the fixed tines 22 and the clips 38 on the respective first leg 30 and second leg 34 of frame structure are attached to different ones of the lateral rods 20.

Figure 10:
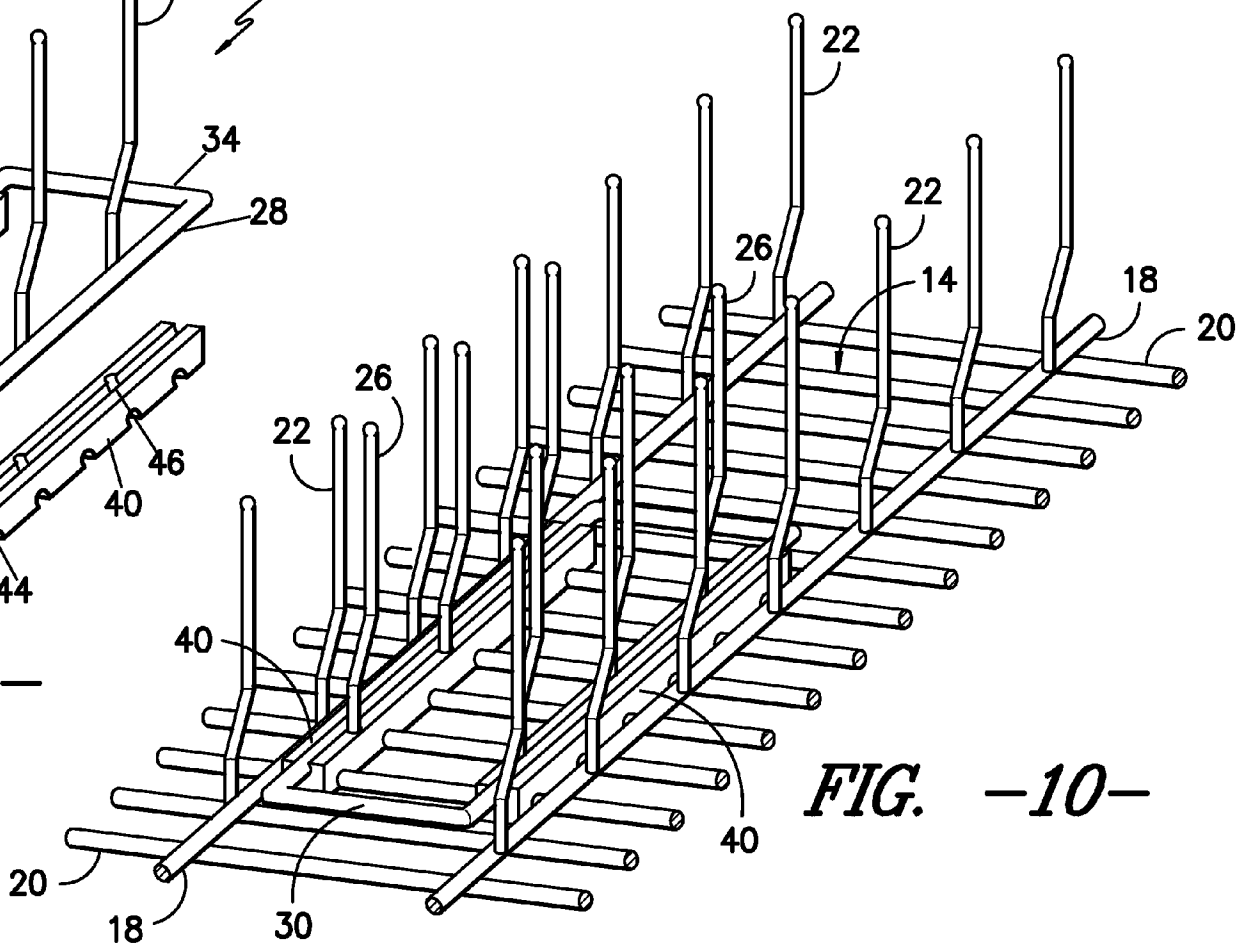
FIG. 10 is a perspective view of the frame structure of FIG. 9 at a first position along the bottom wall of the rack assembly.
Figure 9:
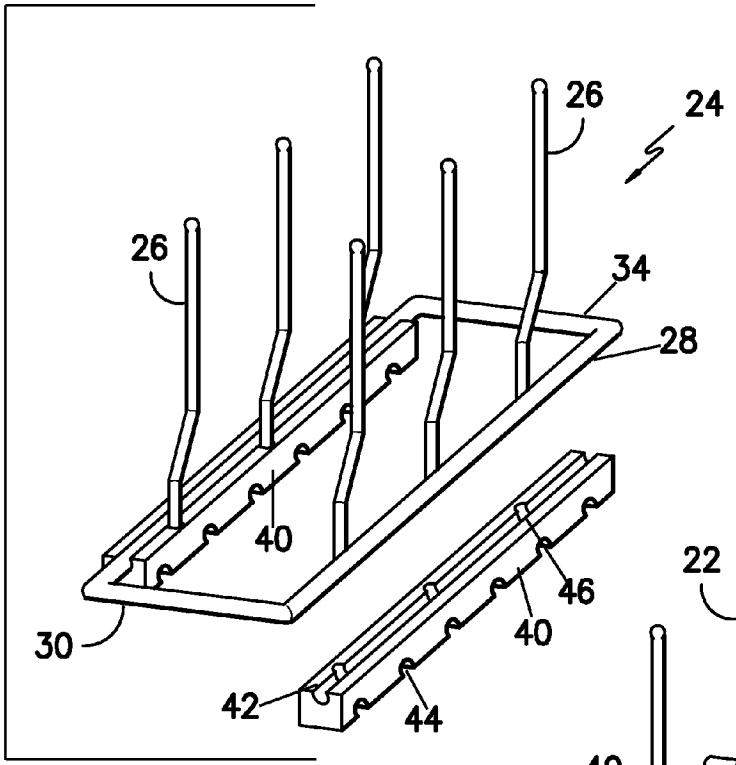
FIG. 9 is a perspective view of still another embodiment of an adjustable frame structure.

FIGS. 9 through 11 depict an alternative embodiment wherein the frame structure 24 is defined as a closed rectangular structure having longitudinal legs 28 and end legs 30, 34. The securement mechanism in this embodiment includes respective channel members 40 that are configured to attach to the lateral rods 20 between the fixed tines 22, as depicted in FIG. 10. The channel members 40 may attach to the rods 20 in any suitable way. In the illustrated embodiment, a plurality of rod positions 44 are defined on the underside of the channel members 40. These rod positions 44 have a size and spacing so that the channel members are essentially snapped or pushed onto the rods 20. The channel members 40 include a top groove 42 into which the longitudinal legs 28 of the frame structure are inserted. Tine positions 46 extend transversely to the top groove 42 and accommodate the tines 26 that are attached to the longitudinal legs 28, as can be readily appreciated from the views of FIGS. 9 and 10.

FIG. 10 depicts the frame structure 24 in a first position wherein the channel members 40 are attached to various ones of the rods 20 in a first position of the frame structure 24 wherein the tines 26 are aligned with the fixed tines 22. FIG. 11 depicts an adjusted position of the frame structure 24 wherein the channel members have been moved and attached to a different set of the rods 20 so that the tines 26 are disposed generally mid-way between the fixed tines 22.

In an alternate embodiment that is similar to the embodiment of FIGS. 9 through 11, the channel members 40 may remain fixed relative to the bottom wall 14, for example attached to the rods 20 as described above, while the frame structure 24 is variably positionable within the channel members, for example by sliding within the top groove 42. Instead of discrete tine positions 46 (FIG. 9), the top groove may form a relatively tight friction fit around the longitudinal legs 28 and bottom portion of the tines 26 that allows for variable infinite positioning of the frame structure 24 relative to the fixed channel members 40. This embodiment may be desired in that the spacing of the tines 26 relative to the fixed tines 22 can be fine-tuned or otherwise varied, and is not dependent on the spacing of the underlying rods 20 defining the bottom wall 14 of the rack assembly 10.

In the illustrated embodiments, the rack assembly 10 is an upper rack for a dishwasher and the fixed vertical tines 22 define a center bowl region 48 of the upper rack (FIG. 2). In this embodiment, the fixed vertical tines 22 are attached to every other ones of the lateral rods 20 along the center bowl region 48, as depicted in FIG. 2. In a first position of the frame structure 24, the tines 26 are aligned with the fixed vertical tines, and in a second position of the frame structure 24, the tines 26 are aligned with the lateral rods 20 that are without fixed vertical tines 22. Depending on the spacing of the lateral rods 20, this second position may place the tines 26 mid-way between the fixed tines 22, as discussed above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher rack assembly, comprising:

a bottom wall formed of spaced apart lateral rods crossed by spaced apart longitudinal rods to define an open lattice structure;

a plurality of fixed vertical tines extending upward from said bottom wall, said fixed vertical tines arranged in pairs along a longitudinal or lateral aspect of said bottom wall with a defined space between adjacent ones of the fixed vertical tines of said pairs of fixed vertical tines;

a rectangular member having a size so as to slide along said bottom wall between the fixed vertical tines of said pairs of fixed vertical tines, said rectangular member having longitudinal legs, said rectangular member having a width such that the longitudinal legs lie directly adjacent the fixed vertical tines of respective ones of said pairs of fixed vertical tines;

a plurality of vertical tines extending upward from said rectangular member and arranged in pairs along said rectangular member, said. plurality of vertical tines spaced apart along the longitudinal legs with a spacing corresponding to said defined space between said pairs of fixed vertical tines; and a securement mechanism configured between said rectangular member and said bottom wall, said securement mechanism accommodating relative movement and anchoring between said rectangular member and said bottom wall for variable positioning of the plurality of vertical tines relative to said pairs of fixed vertical tines, said rectangular member adjustable between a first anchored position wherein the plurality of vertical tines are spaced mid-way between said pairs of fixed vertical tines and a second anchored position wherein the plurality of vertical tines are aligned with said fixed vertical tines.

2. The dishwasher rack assembly as in claim 1, wherein said rectangular member includes a first end leg that connects to a first one of said rods of said bottom wall in said first anchored position and to a second adjacent one of said rods in said second anchored position.

3. The dishwasher rack assembly as in claim 2, wherein said securement mechanism comprises clips that attach said first end leg to said rods.

4. The dishwasher rack assembly as in claim 3, wherein said rectangular member further comprises hooks at ends of said longitudinal legs opposite from said first end leg, said hooks having a length and shape so as to extend around and. under said rods of said, bottom wall.

5. The dishwasher rack assembly as in claim 3, wherein said rectangular member comprises a second end leg opposite from said first end leg, said second end leg also connectable to the first and second ones of said rods of said bottom wall in said first and second anchored positions of said rectangular member.

6. The dishwasher rack assembly as in claim 1, wherein said securement mechanism comprises channel members that attach to said bottom wall between the fixed vertical tines of respective ones of said pairs of fixed vertical tines, the longitudinal legs of said rectangular member slidable within said channel members.

7. The dishwasher rack assembly as in claim 6, wherein said rectangular member is variably positionable along said channel members.

8. The dishwasher rack assembly as in claim 6, wherein said channel members comprise discrete position locations spaced along lengths thereof for receipt of respective ones of the plurality of vertical tines.

9. The dishwasher rack assembly as in claim 6, wherein said channel members attach to said lateral rods of said bottom wall.

10. The dishwasher rack assembly as in claim 1, wherein said rack assembly is an upper rack for a dishwasher and said fixed vertical tines define a center bowl region of said upper rack.

11. The dishwasher rack assembly as in claim 10, wherein said fixed vertical tines are attached to every-other said lateral rod along said center bowl region, wherein in the second anchored position of said rectangular member, the plurality of vertical tines are aligned with said fixed vertical tines, and in the first anchored, position of said rectangular member, the plurality of vertical tines are aligned with said lateral rods that are without said fixed vertical tines.

12. A dishwasher appliance, comprising:

a tub; and a rack assembly positioned within said tub, said rack assembly comprising:

a bottom wall formed of spaced apart lateral rods crossed by spaced apart longitudinal rods to define an open lattice structure;

a plurality of fixed vertical tines extending upward from said bottom wall, said fixed vertical tines arranged in pairs along a longitudinal or lateral aspect of said bottom wall with a defined space between adjacent ones of the fixed vertical tines of said pairs of fixed vertical tines;

a rectangular member having a size so as to slide along said bottom wall between the fixed vertical tines of said pairs of fixed vertical tines, said rectangular member having longitudinal legs, said rectangular member having a width such that the longitudinal legs lie directly adjacent the fixed vertical tines of respective ones of said pairs of fixed vertical tines;

a plurality of vertical tines extending upward from said rectangular member and arranged in pairs along said rectangular member, said plurality of vertical tines spaced apart along the longitudinal legs with a spacing corresponding to said defined space between said pairs of fixed vertical tines; and a securement mechanism configured between said rectangular member and said bottom wall, said securement mechanism accommodating relative movement and anchoring between said rectangular member and said bottom wall for variable positioning of the plurality of vertical tines relative to said pairs of fixed vertical tines, said rectangular member adjustable between a first anchored position wherein the plurality of vertical tines are spaced mid-way between said pairs of fixed vertical tines and a second anchored position wherein the plurality of vertical tines member are aligned with said fixed vertical tines.

13. The dishwasher appliance as in claim 12, wherein said rectangular member includes a first end leg that connects to a first one of said rods of said bottom wall in said first anchored position and to a second adjacent one of said rods in said second anchored position.

14. The dishwasher appliance as in claim 13, wherein said securement mechanism comprises clips that attach said first end leg to said rods.

15. The dishwasher appliance as in claim 14, wherein said rectangular member further comprises hooks at ends of said longitudinal legs opposite from said first end leg, said hooks having a length and shape so as to extend around and under said rods of said bottom wall.

16. The dish washer appliance as in claim 14, wherein said rectangular member comprises a second end leg opposite from said first end leg, said second end leg also connectable to the first and second ones of said rods of said bottom wall in said first and second anchored positions of said rectangular member.

17. The dishwasher appliance as in claim 12, wherein said securement mechanism comprises channel members that attach to said bottom wall between the fixed vertical tines of respective ones of said pairs of fixed vertical tines, the longitudinal legs of said rectangular member slidable within said channel members.

18. The dishwasher appliance as in claim 17, wherein said rectangular member, is variably positionable along said channel members.

19. The dishwasher appliance as in claim 17, wherein said channel members comprise discrete position locations spaced along lengths thereof for receipt of respective ones of the plurality of vertical tines.

20. The dishwasher appliance as in claim 17, wherein said channel members attach to said lateral rods of said bottom wall.

* * * * *